US005145412A

United States Patent [19]

Tan et al.

[11] Patent Number: 5,145,412

[45] Date of Patent: Sep. 8, 1992

[54] FILTER CONNECTOR

[75] Inventors: Haw-Chan Tan, Diamond Bar; Nobbert Yu, Culver; Yuan-Chieh Lin, El Toro; Vincent Chen, Walnut, all of Calif.

[73] Assignee: Foxconn International, Inc., Sunnyvale, Calif.

[21] Appl. No.: 779,538

[22] Filed: Oct. 18, 1991

[51] Int. Cl.[5] ..... H01R 13/66

[52] U.S. Cl. ..... 439/620; 333/185

[58] Field of Search ..... 439/620; 333/181-185

[56] References Cited

U.S. PATENT DOCUMENTS 4,797,120 1/1989 Ulery ..... 439/620

4,884,982 12/1989 Fleming et al. ..... 439/620

4,934,960 6/1990 Capp et al. ..... 439/620

*Primary Examiner*—Gary F. Paumen

[57] ABSTRACT

A housing has a hollow portion to receive a ferrule, and a support member is positioned between the housing and the ferrule. A plurality of electrical elements are selectively positioned within the housing in electrically conductive contact with the support member. A detachable shell is closely positioned on the housing in circumscribing relation with the support member and in electrically conductive relation with the electrical elements to completely shield and enclose the electrical elements. Removing the electrical elements, the rest parts of the assembly is deemed as a semi-finished product and can be stored as inventory for a later time use according to the customer's requirements.

16 Claims, 3 Drawing Sheets

FILTER CONNECTOR

BACKGROUND OF THE INVENTION

1. Field of the Invention

The present invention relates to electrical connectors and, more particularly, to filter connectors.

2. Description of the Related Art

As disclosed in U.S. Pat. No. 4,884,982, a filtered BNC connector includes a conductive clip adapting to an outer profile of an electrical connector and providing a capacitive coupling with multiple conduction paths through capacitor elements held by the clip in pressure engagement with a conductive shell of the connector, the clip further providing a voltage discharge path between the clip and the shell. Some disadvantages are shown as below. Although the capacitor is positioned within the connector, as shown in FIG. 4 of U.S. Pat. No. '982, the end electrode of the capacitor is shown and required to protrude out of the recess in which it is contained to contact the clip. On the other hand, the side leg of the clip stands obliquely to contact and press against the exposed and protruding end electrode of said capacitor. This type design results from the requirement that (1) the clip needs to be positioned within the outer profile of the connector by its own elasticity; and (2) the clip needs to contact the capacitor and give sufficient pressure to the capacitor to maintain a good electrical and mechanical contact. According to this type structure, the disadvantages include the fact that the capacitor is not enclosed as a sealed type; therefore the capacitor's function is effected and reduced, even exposing it to damage by external environmental factors. As shown in FIG. 4 of U.S. Pat. No. '982, although it is intended to have the clip inset within the outer profile of the connector for keeping the original dimension, it can still be seen that inclination of the clip and protrusion of the capacitor jeopardize an even and smooth surface. As shown in FIG. 2 of U.S. Pat. No. '982, another disadvantage is that a process is required to form an enlarged rivet head on the peg by the application of heat and pressure to overlie and retain the clip, as mentioned at lines 60–62 of column 3 of the specification of U.S. Pat. No. '982. This retention process also prohibits the whole assembly from reconfiguring or repairing when it is required to replace the inside malfunctioning capacitor.

The main reason which results in these disadvantages is to have the clip function both as a holding means for supplying pressure contact, and as an externally shielding plus contacting means. Based on this reason, the design of U.S. Pat. No. '982 can not help but have this type structure and this disadvantages.

SUMMARY OF THE INVENTION

In order to overcome the foregoing disadvantages of the prior art filter connector, it is an object of the present invention to provide a filtered BNC connector which encloses the capacitors in a sealed situation for preventing damage or malfunction due to external environmental factors.

Another object of the present invention is to provide a filtered BNC connector which can keep smooth outer surfaces without any biased components exposed outside.

A further object of the present invention is to provide a conductive shell which can be secured to the insulator with a snap.

Yet another object of the present invention is to provide a detachable shell which can form a semi-finished product for flexible manufacturing and customizing.

In accordance with these and other objects, the present invention includes a dielectric hollow housing defining a plurality of cavities or passages extending in the radial direction. A conductive ferrule accompanying a support member having a plurality of fingers extending thereon, is positioned within the housing, in which an inner contact and an insulator are disposed. A plurality of conductive electrical elements are inserted into the corresponding cavities to conductively contact the support member, and a conductive resiliently contractible shell is disposed on the housing to cover and conductively contact the electrical elements.

The present invention uses an inner support member to provide the required pressure for holding and conductively contacting the electrical elements, then the outer shell is applied to be conformable to the outer profile of the housing and provide perfect grounding and shielding functions.

DETAILED DESCRIPTION OF THE PREFERRED EMBODIMENT

Figure 1:
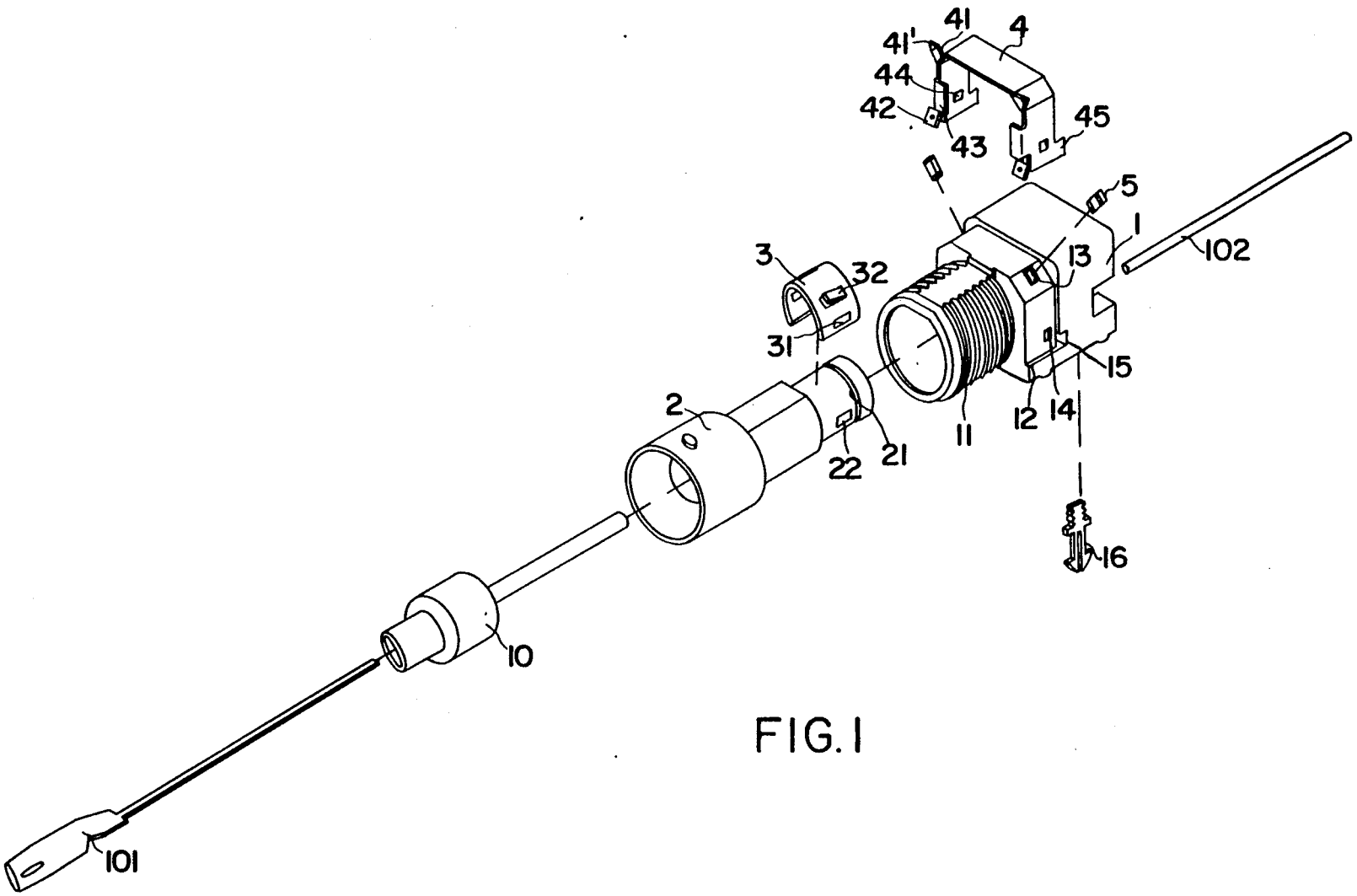
FIG. 1 is a perspective exploded view of the filter connector of the present invention.

Reference will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

It will be noted here that for a better understanding, like components are designated by like reference numerals throughout the various figures. Referring to FIG. the subject connector includes a dielectric housing 1 having a hollow portion 11 extending therefrom, and a conductive ferrule 2, a portion of which is positioned within the hollow portion 11. An tubular insulator 10 positioned within the ferrule 2 receives an inner contact 101 therein. A grounding contact 102 accompanies the ferrule 2 by the side of the insulator 10. A circumferentially shallow slot 2 positioned at one reduced diameter end of the ferrule 2, has a pair of integral diametrically opposed protrusions 22 thereon. A C-shaped spring metal band 3 having a pair of apertures 31, is inset into the circumferential slot 21 to prevent the spring metal band 3 from axial movement. The apertures 31 receive the corresponding protrusions 22 of the ferrule 2 to fix the band 3 within the slot 21 and thus achieve an anti-rotation function within the slot 21. A plurality of tangs 32 extend outwardly on the surface of the spring metal band 3. In this embodiment, the tangs 32 are formed by stamping the material of the spring metal band 3 directly so that one end of the tang 32 lies spaced from the peripheral surface of the band 3.

A shallow groove 12 is formed on the middle portion of the housing 1 for receiving a conductive metal shell 4. A plurality of cavities or passageways 13 extending through the middle portion of the housing 1 in the radial direction, and are configured to receive a plurality of conductive chips 5 as shown in FIG. 1. A pair of recesses 14 are located on two lateral sides and a pair of hollows 15 are positioned on two sides adjacent the recesses 14. A pair of mounting device 16, only one being shown in the figures, are retained on the bottom surface of the housing to secure the connector on a board (not shown).

The shell 4 has a generally U-shaped body including two pairs of spring members 41, 42 to assure good contact between the shell 4 and a mounting means for the connector comprising a conductive panel (not shown), in which one pair 41 protrude radially outward from the forward edge of the shell 4, each having an angular bend 41' at the end. The other pair 42 extend from a pair of lateral extending flanges 43, which extend integrally from the forward edge of the shell 4. To enhance elasticity, the spring member 42 extends in an oblique direction from the flange 43 as shown. A pair of inwardly projecting tangs 44 are positioned on two sides of the U-shaped shell 4 corresponding in position to the recesses 14 of the housing 1 for fastening the shell 4 in the groove 12 of the middle portion of the connector body 1. A pair of integral retention members 45 are disposed backwardly at two ends of the shell 4 to engage the hollows 15 of the housing 1 to enhance stability of the shell 4 when applied to the shallow groove 12. The inner portion of the hollow 15 conforms to the contour of the retention member 45.

Figure 2:
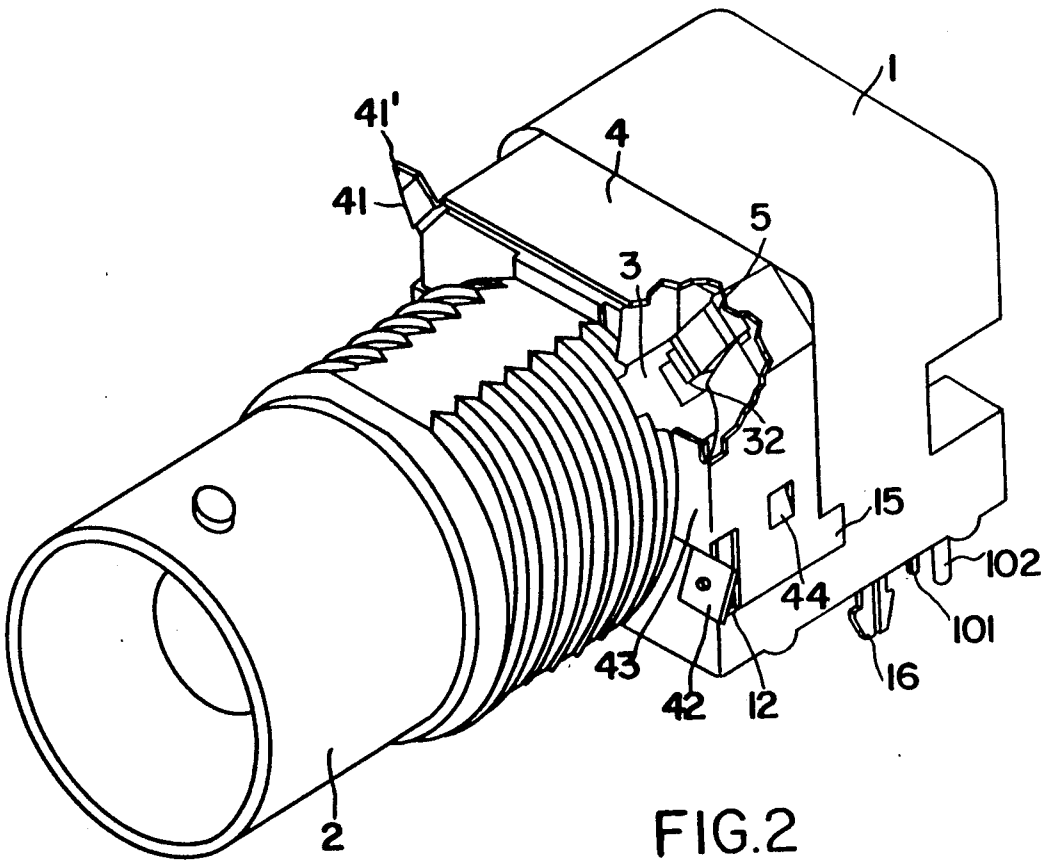
FIG. 2 is a perspective view of the assembled connector of FIG. 1, a portion being broken away to reveal underlying parts.
Figure 3:
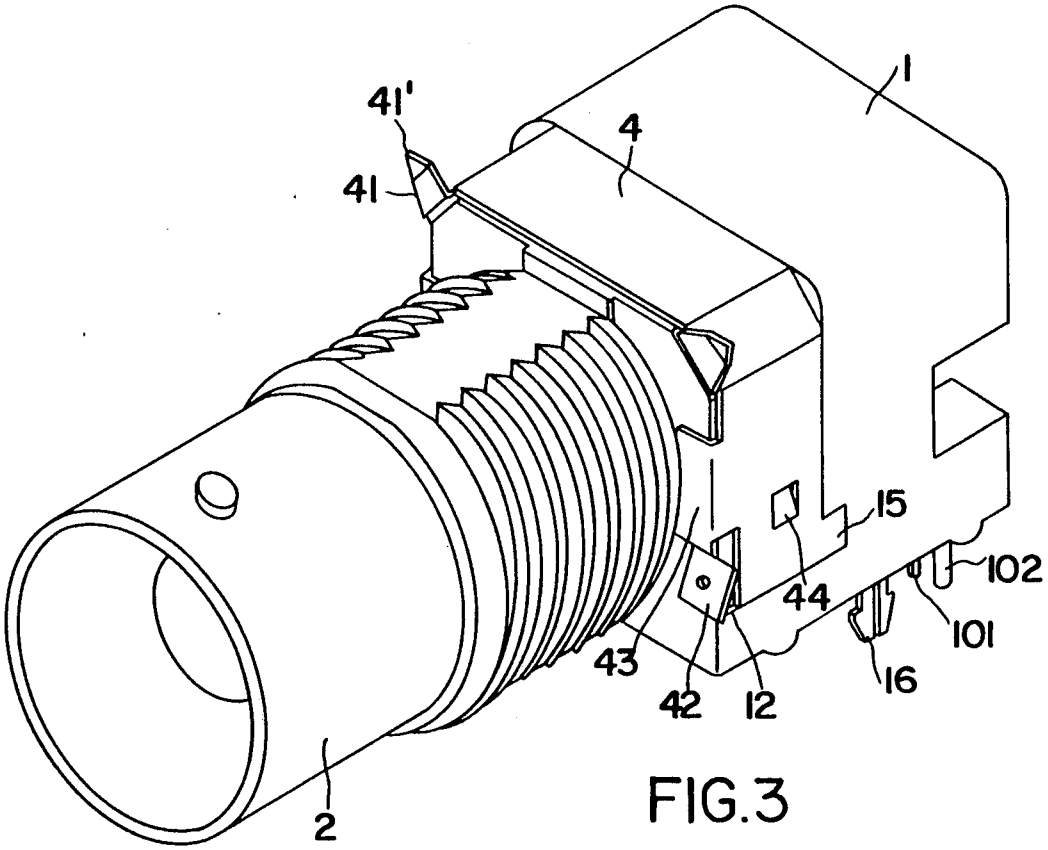
FIG. 3 is a complete perspective view of the connector of FIG. 2.

When assembling, referring to FIGS. 2 & 3, the C-shaped spring metal band 3 is inserted into the circumferential slot 21 of the ferrule 2, and the protrusions 22 of the ferrule 2 are positioned within the apertures 31 of the metal band 3 respectively, so the metal band 3 is detachably fixed in place.

The ferrule 2 operatively associated with the C-shaped metal band 3, the insulator 10 and the inner contact 101, is inserted coaxially into the interior of hollow portion 11 of the housing 1, the flat exterior surface portion of the ferrule registering with the flat interior surface in the hollow portion 11 to orient the two elements in relation to one another. An expansion portion (not shown) can be formed at the tail end of the ferrule 2 to fasten the ferrule 2 to the housing 1. As shown in FIGS. 2 & 3, the tails of the inner contact 101 and the grounding contact 102 are bend at a right angle for engaging the corresponding board (not shown). The chips 5 are then inserted into the cavities 13 of the housing 1, and one electrode end of each chip 5 drops into place against the corresponding resilient tang 32 of the metal band 3. The registry of the two flat surfaces on the ferrule and hollow portion 11 prevent rotational misalignment of the parts, thus ensuring the conductive contact relationship between the conductive chips 5 and the tangs 32.

To complete the assembly, the shell 4 is detachably installed within the groove 12 of the housing 1. The projecting tangs 44 snap into the recesses 14 of the housing 1 to prevent inadvertent removal of the shell 4, and the retention members 45 are pressed into the hollows 15, so the shell is detachably positioned securely within the groove 12 of the housing Meanwhile, the other electrode end of the chip 5 conductively contacts the shell 4 by pressure due to the corresponding tang 32 of the metal band 3. Thus, a filtering electrical path is formed through ferrule 2, tang 32 of metal band 3, conductive chip 5, metal shell 4, spring members 41, 42 and flanges 43, with a metallic panel (not shown) having an aperture to receive the threaded hollow portion 11 of the housing 1, which is then engaged by an appropriate nut (not shown) to clamp the assembled connector to the panel. This filtering will discharge a voltage from the ferrule to the panel.

It can be understood for the foregoing that the present invention has interiorly a metal band 3 having the tangs 32 to offer better and stable spring contact with the corresponding chips. There is no possibility for the metal band 3 to move from its true position by any external factor, so the pressure contact offered by metal band 3 is reliably and stably effective.

It is appreciated that in the present invention each conductive chip 5 is completely covered by the shell 4 as a sealed (or closed) type, i.e. no portion of the chip is exposed to the outside, so that there is no possibility that the external factors will weaken the chip's function or damage the chip.

It is noted that in present invention, the external shell 4 does not function as an actuating means to provide a pressure contact on the chips as the oblique clip disclosed in the prior art, but only functions as a shielding means and a contacting means. This allows the shell to be closely fixedly fastened on the outer profile of the middle portion of the connector and keep a completely and continuously shielding around that area.

It is also appreciated that additional cavities can be radially disposed of the housing to receive other electrical components, such as resistors, for extra functions. It can be understood that in the present invention there is no difference of appearance whether the chips or other electrical components are inset within the corresponding cavities or not. Further, by using a tool, the shell 4 can be detached from the housing to replace the inside malfunctioning electrical components or install additional electrical components. In contrast, the prior art connector needs to use an additional heat and pressure process to retain the biased clip on the housing when the chips are installed within the cavities, and it will not allow the possibility of repair or replacement of the inner corresponding electrical elements without destruction. So, the present invention is repairable and reconfigurable or reprogrammable, and is more suitable for application of flexible manufacturing system and offering multi-selections to the different customers having different requirements. The removability of the shell also provides the present invention with a semi-finished product which comprises the whole elements of the present invention except the chips. This type semi-finished product can be stored in quantity as inventory and in a later time, according to the customer's requirement, the chips or other electrical elements are selectively inserted into the corresponding cavities to achieve the different functions in different operation levels. Through this semi-finished product, the cost and the inventory can be minimized, but versatility of connectors can still be expected.

What is claimed is:

1. A filter connector comprising:

a hollow housing defining a plurality of cavities therethrough radially; an electrically conductive ferrule surrounding an insulator and an inner contact therein, said ferrule including a support member thereon having a plurality of resilient fingers extending outwardly therefrom and positioned within the hollow housing;

an electrical element selectively positioned within each of the plurality of cavities in electrically conductive contact with one of said resilient fingers; and a shell closely mounted on the housing to completely shield and conductively contact the electrical elements.

2. The filter connector of claim 1 wherein the support member comprises a C-shaped spring metal band having a plurality of integral tangs extending from on the surface of the spring metal band as resilient fingers.

3. The filter connector of claim 2 wherein the ferrule has a shallow circumferential slot to receive the C-shaped spring metal band, and a pair of integral protrusions diametrically positioned thereon and adapted to engage a pair of corresponding apertures formed in the spring metal band.

4. The filter connector of claim 1 wherein the housing has a shallow groove to receive the shell, said plurality of cavities extending radially into said hollow housing from said shallow groove, a pair of projecting tangs positioned on two sides of the shell adapted to engage a pair of corresponding recesses formed in the shallow groove of the housing, and a pair of shell retention members projecting from the ends of the shell adapted to engage a pair of correspondingly configured hollows formed in the housing.

5. The filter connector of claim 2 wherein the shell comprises a U-shaped metal body including two pairs of spring metal members, one pair of said spring mental members protruding integrally from an edge of the shell and each having an angular bend at the end, the other pair of said spring metal members extending from a pair of integral flanges each of which individually extends integrally from a corresponding edge of the shell.

6. The filter connector of claim 1 wherein the shell is detachable.

7. The filter connector of claim 1 wherein at least one mounting device is attached to the housing for reception in an aperture of a board, and a grounding contact is attached to the shell for grounding.

8. A filter connector comprising a dielectric housing having a hollow portion adapted to receive a metallic ferrule enclosing an insulator and an inner contact, a metallic support member positioned between the housing and the ferrule, a plurality of electrical elements selectively positioned within the housing in electrically conductive contact with the support member, means on the support member which apply a spring contact force on the electrical elements, and a metallic shell closely positioned on the housing in circumscribing relation with the support member and in electrically conductive relation with the electrical elements to completely shield and enclose the electrical elements.

9. The filter connector of claim 8 wherein the shell includes means for detachably fastening the shell on the housing, and the support member includes means for fastening the support member on the ferrule.

10. The filter connector of claim 9 wherein a plurality of cavities are positioned radially in the housing to receive the corresponding electrical elements.

11. The filter connector of claim 9 wherein the metallic shell has a generally U-shaped body including a pair of spring members extending integrally from an edge of the shell.

12. The filter connector of claim 9 wherein the support member has a C-shaped body positioned in a groove of the ferrule.

13. The filter connector of claim 9 wherein a mounting device is positioned on the housing for reception in an aperture of a board, and a grounding contact is attached to the shell for grounding.

14. A semi-finished filter connector comprising a dielectric housing having a hollow portion adapted to receive a metallic ferrule enclosing an insulator and an inner contact, a metallic support member positioned between the housing and the ferrule, a plurality of cavities for receiving a plurality of selective electrical elements defined through the housing radially in circumscribing relation with the support member, and a metallic shell closely and detachably positioned on a portion of the housing to completely shield and enclose the cavities of the housing.

15. The semi-finished filter connector of claim 14 wherein the metallic support member has a C-shaped body including means for fastening the support member on the ferrule, and the shell has a U-shaped body including means for fastening the shell on the housing.

16. The semi-finished filter connector of claim 15 wherein a mounting device is positioned on the housing for reception in an aperture of a board, and a grounding contact is attached to the shell for grounding.

* * * * *